United States Patent [19]

Yokoyama et al.

[11] 4,408,561

[45] Oct. 11, 1983

[54] DUAL-PURPOSE PLANT FOR PRODUCING COLD ROLLED STEEL SHEET AND HOT-DIP GALVANIZED STEEL SHEET

[75] Inventors: Hideo Yokoyama, Ikuhashishi; Ichiro Shimbashi; Koichi Sakurai, both of Kitakyusyushi; Munetsugu Matsuo, Kawasakishi, all of Japan

[73] Assignee: Nippon Steel Corporation, Tokyo, Japan

[21] Appl. No.: 295,316

[22] Filed: Aug. 24, 1981

[51] Int. Cl.[3] ..... B05D 1/18

[52] U.S. Cl. ..... 118/72; 118/64; 118/101; 118/419; 427/319; 427/321; 427/348; 427/360; 427/398.3; 427/398.4; 427/432; 427/433; 427/436

[58] Field of Search ..... 427/321, 337, 348, 360, 427/398.2, 398.3, 398.4, 436, 433, 431, 432; 118/419, 59, 63, 69, 101, 72, 73

[56] References Cited

U.S. PATENT DOCUMENTS

| | | | |
|---|---|---|---|
| Re. 24,985 | 5/1961 | Renkin | 118/419 |
| 131,681 | 9/1872 | Hill | 118/73 |
| 3,993,803 | 11/1976 | Camardella | 427/433 X |

FOREIGN PATENT DOCUMENTS

| | | |
|---|---|---|
| 51-149129 | 12/1976 | Japan . |
| 53-132437 | 11/1978 | Japan . |
| 54-19407 | 2/1979 | Japan . |
| 55-110735 | 8/1980 | Japan . |

*Primary Examiner*—Shrive P. Beck

*Attorney, Agent, or Firm*—Wenderoth, Lind & Ponack

[57] ABSTRACT

A dual-purpose production plant for cold rolled steel sheets and hot-dip galvanized steel sheets having, successively disposed in series, a heating zone, a soaking zone, a primary cooling zone, an overaging zone equipped with a controlled cooling facility, a molten galvanizing zone, an intermediate cooling means, a secondary cooling zone, a temper rolling means, and a chemical treatment means, and a bypass for directly connecting the overaging zone and the secondary cooling zone with each other.

26 Claims, 10 Drawing Figures

DUAL-PURPOSE PLANT FOR PRODUCING COLD ROLLED STEEL SHEET AND HOT-DIP GALVANIZED STEEL SHEET

FIELD OF THE INVENTION

This invention relates to a dual-purpose plant for producing cold rolled steel sheets and hot-dip galvanized steel sheets and more particularly to a dual-purpose plant for producing cold rolled steel sheets and hot-dip galvanized steel sheets of deep drawing steel and high strength steel which is hardened by solid solution and dual-phase structure.

BACKGROUND OF THE INVENTION

A dual-purpose plant for producing deep drawing steel sheets and hot-dip galvanized steel sheets is disclosed in published Japanese Pat. Appln. No. 132,437/'78. In the known production plant, a reheating zone and a hot-dip galvanizing apparatus are provided at the outlet side of a secondary cooling zone following an overaging zone of a continuous annealing line and said galvanizing apparatus is movable in the vertical direction so that the plant can be used either for production of cold rolled steel sheets or the production of hot-dip galvanized steel sheets and can be switched back and forth freely between these two modes of operation. This plant, however, has disadvantages in that it includes both a reheating zone and a means for vertically moving the galvanizing apparatus, thus increasing the cost of the plant as well as its operating cost, and in that, since the strip is reheated after the overaging treatment, carbides precipitated in the matrix of the steel dissolve in solid solution again, degrading the mechanical properties as a result thereof. Moreover, since the galvanizing apparatus is provided at the outlet side of a secondary cooling zone, an additional cooling means is required to cool the strip after galvanizing, which also results in increasing the cost of the plant.

A dual-purpose plant using continuous hot-dip galvanizing equipment and production equipment for black plates is disclosed in published Japanese Pat. Appln. No. 19,407/'79. In this plant, a hot-dip galvanizing apparatus and a roundabout passaageway are provided between the primary cooling zone of a continuous annealing line for black plates and the overaging zone thereof. In this plant, however, since the galvanized steel sheets are subjected to overaging, alloy formation occurs in the zinc layer of the steel sheet with iron as the substrate during the overaging, whereby the adhesive strength of the galvanized layer is degraded. Also, in this plant, the overaging temperature is kept low for preventing hearth rolls disposed in the overaging zone from picking up zinc from the zinc layer in the overaging treatment. As a consequence, the effect of the averaging is not sufficient to produce deep drawing galvanized steel sheets of satisfactory quality. Moreover, the plant does not possess an in-line temper rolling means which is indispensable to a continuous annealing line having an overaging zone.

For eliminating these defects in plants wherein the overaging treatment system includes reheating before galvanizing and in plants wherein the overaging is carried out after galvanizing, there has been proposed in published Japanese Pat. Appln. No. 149,129/'76 a process wherein a preliminary overaging is conducted before galvanizing and a further, secondary overaging is conducted after galvanizing. In the proposed process, the overaging before galvanizing, which is a preliminary treatment, is performed over a short period of time and then after finishing the galvanizing, a regular overaging treatment at a proper temperature above 350° C. is conducted. However, with this process, adhesion of zinc to the hearth rolls in the overaging zone during the regular overaging treatment is inevitable and any countermeasure taken to avoid this trouble is certain to considerably increase the cost of the plant.

SUMMARY OF THE INVENTION

An object of this invention is to overcome the above-mentioned disadvantages in overaging treatments conducted before or after hot-dip galvanizing in conventional processes while at the same time solving the problem of increased equipment and operating costs in a dual-purpose plant for producing cold rolled steel sheets and hot-dip galvanized steel sheets, and to provide a plant capable of being used for producing both cold rolled steel sheets and hot-dip galvanized steel sheets (such a plant being referred to as a "dual-purpose plant" in this specification) having excellent performance characteristics.

Another object of this invention is to provide a plant for producing deep drawing hot-dip galvanized steel sheets, particularly for car bodies, having zinc plating with good adhesive strength and having excellent performance characteristics as well as for producing galvanized steel sheets of high strength steel which is hardened by solid solution and dual-phase structure.

That is, the invention provides a dual-purpose production plant for cold rolled steel sheets and hot-dip galvanized steel sheets comprising, successively disposed in series, a heating zone, a soaking zone, a primary cooling zone, an overaging zone equipped with a controlled cooling facility, a molten galvanizing zone, an intermediate cooling means, a secondary cooling zone, a temper rolling means, and a chemical treatment means, and a bypass means for directly connecting said overaging zone and said secondary cooling zone with each other.

DETAILED DESCRIPTION OF THE INVENTION

According to the first aspect of this invention, there is provided a dual-purpose production plant for cold rolled steel sheets and hot-dip galvanized steel sheets comprising, successively disposed in series, a heating zone, a soaking zone, a primary cooling zone, an overaging zone equipped with a controlled cooling facility, a hot-dip galvanizing zone, an intermediate cooling means, a secondary cooling zone, a temper rolling means, and a chemical treatment means, and a bypass means for directly connecting said overaging zone and said secondary cooling zone with each other.

This arrangement is particularly suitable for producing cold rolled steel sheets and hot-dip galvanized steel sheets of deep drawing steel and high strength steel hardened by solid solution.

Figure 1:
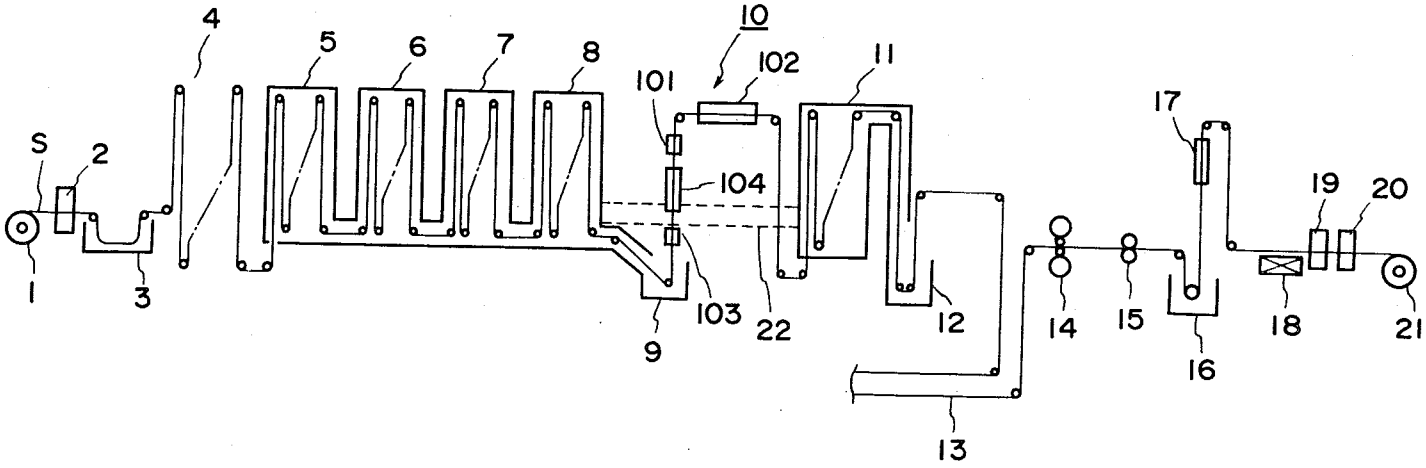
FIG. 1 is a schematic view of a plant line showing an embodiment according to the first aspect of this invention.

FIG. 1 shows a concrete example of the structure of a plant of this invention.

The plant line shown in FIG. 1 is equipped with such ordinary auxiliary equipment as a welder 2 for welding the starting material, a payoff reel 1 from which a cold reduced steel strip S is uncoiled, an electrolytic cleaning section 3 for cleaning the surface of the steel strip S, and an entry looper 4. Following this auxiliary equipment, there are provided successively in series according to the first aspect of this invention a heating zone 5, a soaking zone 6, a primary cooling zone 7, an overaging zone 8, a hot-dip galvanizing apparatus 9, an intermediate cooling means 10, a secondary cooling zone 11, a water cooling means 12, a delivery looper 13, a temper rolling mill 14, a trimmer 15, a chemical surface treatment means 16, a dryer 17, an inspection apparatus 18, an oil coater 19, a shearing machine 20, and a coiler 21. Also according to the first aspect of this invention, a bypass 22 is provided for directly passing the steel strip S coming from the overaging zone 8 to the secondary cooling zone 11.

The individual constituent elements mentioned above are described below in detail.

The heating zone 5 has an indirect heating system using radiant tubes. Therefore, it is necessary to dispose an electrolytic cleaning means at the inlet side of the heating zone for removing the iron powder which has adhered to the surface of the cold reduced steel strip in the cold rolling step. Although there is no need for such a cleaning means when a non-oxidation direct-fired heating furnace is employed in conjunction with a conventional plant or installation of this type for producing hot-dip galvanized steel sheets, it is necessary to provide one for use when producing cold rolled steel sheets which are required to have strictly controlled surface properties since without one there is a possibility that the surface will be degraded by the formation of a porous layer which gives the surface poor corrosion resistance or of the surface being degraded by the formation of pick-up scars.

In addition, in the plant of this invention it is preferred that the gas atmosphere in the heating zone, the soaking zone, the primary cooling zone, and the overaging zone contain about 5–30% $H_2$ to activate the surface of the cold rolled steel strip before the steel is subjected to the hot-dip galvanizing treatment. Also, as the chemical used for the electrolytic cleaning, it is recommended to avoid the use of one based on sodium silicate and to use one based on sodium hydroxide instead.

Moreover, it is preferable to employ a gas jet cooling system in the primary cooling zone.

As the primary cooling system in the continuous annealing of cold rolled steel sheets, there are commonly used not only gas jet cooling systems but also mist cooling systems, water cooling systems, etc. However, in the dual-purpose type production plant of this invention, a gas jet cooling system is most suitable for the following reason. When a mist cooling system is used, the surface of the steel strip is oxidized during primary cooling and the oxidized layer usually remains even after the overaging treatment. As a result, the steel strip is not suitable for hot-dip galvanizing. Also, when a water cooling system is used, since the end point temperature of cooling cannot be controlled in the primary cooling, the steel strip must be reheated to the overaging temperature before overaging, which results in an energy loss and the degradation of mechanical properties. However, the gas jet cooling system does not cause such difficulties. Furthermore, since the steel strip is bright cooled by a gas jet cooling system, the steel strip can subsequently be subjected to hot-dip galvanizing without any trouble. Moreover, since the cooling end point temperature can be controlled in a gas jet cooling system, it is unnecessary to reheat the steel strip for the subsequent overaging treatment, whereby energy costs can be reduced and a galvanized steel sheet of good quality can be obtained.

In addition, a metal contact cooling system can also be employed as the primary cooling system in this invention with the same effect as a jet cooling system. In the metal contact cooling system, a steel strip is cooled by, for example, bringing into contact with the steel strip a metallic rotator through the inside of which cooling water is passed As in the case of employing the gas jet cooling system, it is also possible by the use of the metal contact system to achieve cooling and control of the end point cooling temperature.

Moreover, cooling can be achieved more rapidly than in the case of employing the gas jet cooling system. Therefore, as compared with employing the gas jet cooling system, it is possible by employing the metal contact cooling system to more effectively:

(i) reduce the overaging period when producing deep drawing cold rolled steel sheets and high strength solid solution hardened cold rolled steel sheets, and (ii) reduce the amount of the alloying elements used when producing high strength dual-phase cold rolled steel sheets.

As the heat retaining system for the overaging zone 8, there can be used an electric resistance indirect heating system. Also, to make controlled cooling of the overaging zone possible, a cooling means such as a weak cooling gas jet cooling system or a cooling tube system may be employed in the overaging zone.

A conventional production plant for continuous hot-dip galvanized steel sheet does not have an overaging zone and hence can produce only hard galvanized steel sheets. When producing such a hard galvanized steel sheet in the plant of this invention, it is necessary to control the overaging zone so that the steel strip is gradually cooled from the primary cooling zone through the overaging zone and thus is not subjected to an overaging treatment in the overaging zone. For this purpose, cooling in the primary cooling zone may be reduced or discontinued but it is necessary that the overaging zone have not only a heat-retaining means but also a controlled cooling means. This is the reason that the overaging zone of the plant is equipped with the controlled cooling facility in accordance with the first aspect of this invention.

A conventional hot-dip galvanizing means can be used as the hot-dip galvanizing apparatus 9 following the overaging zone 8.

The galvanized deep drawing steel or high strength steel sheets produced by the plant of this invention are used mainly for car bodies and hence thin plating is frequently conducted. Therefore, the hot-dip galvanizing apparatus of the plant of this invention through which a steel strip to be galvanized is passed at a high speed can be equipped with a means such as a high pressure $N_2$ gas wiper for carrying out thin galvanizing. Also, the galvanizing apparatus may be equipped with a one-side galvanizing means and also with an intermediate cooling means covered by a hood for protecting the galvanized steel strip from atmospheric oxidation when the steel strip enters the secondary cooling zone.

The intermediate cooling means 10 disposed between the hot-dip galvanizing apparatus 9 and the secondary cooling zone 11 is composed of an intermediate primary cooling section 101 and an intermediate secondary cooling section 102, each of which is equipped with a gas jet cooling means. In addition, for two-side galvanizing, an air jet cooling means may be used in place of the gas jet cooling means, and further a water spray may be used for the intermediate secondary cooling section 102 and hence in such case a dryer is required.

Figure 7:
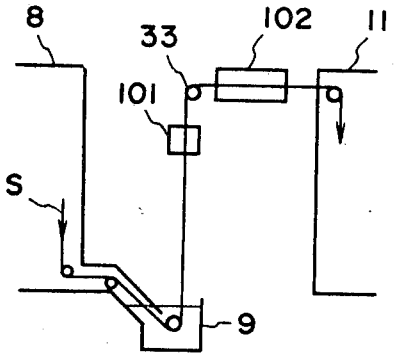
FIG. 7 is a schematic view showing an intermediate cooling section disposed between the galvanizing bath and the secondary cooling zone for use in producing galvanized steel sheets of deep drawing steel and high strength solid solution hardened steel.

The manner in which the intermediate cooling apparatus is used is explained with reference to the example shown in FIG. 7.

When hot-dip galvanizing a deep drawing steel or high strength solid solution hardened steel, the galvanized steel strip S which is at a temperature of about 460° C. coming from the hot-dip galvanizing bath 9 is passed through a primary intermediate cooling section 101 disposed ahead of a deflector roll 33 to cool the steel strip to a temperature below about 400° C., preferably below about 350° C., whereby pick-up of zinc from the zinc layer of the steel sheet by the deflector roll 33 can be prevented. In addition, it is more effective for preventing pick-up of zinc if the deflector 33 itself is of an internal water-cooled type. The steel strip S is passed over the deflector roll 33 and further through the secondary intermediate cooling section 102, wherein it is cooled to a temperature below about 350° C., preferably about 300° C., at which zinc in the galvanized layer of the steel strip S is not picked up by a guide roll in the secondary cooling zone 11 when the steel strip S is passed through the secondary cooling zone 11.

In addition, for producing a zero-spangle galvanized steel sheet by the plant line of this invention, a means 103 for zero-spangling the galvanized layer by blowing, for example, steam on the surface of the steel strip directly after galvanizing is disposed just above the molten galvanizing bath 9 as shown in FIG. 1.

Also, for producing a galvanized steel sheet having an alloyed galvanized layer by the plant line of this invention, an alloying furnace 104 for heating the surface of the steel strip to about 550° C. directly after galvanizing is disposed above the galvanizing bath 9.

The steel strip is reheated in the alloying furnace to a temperature higher than the overaging temperature (about 460° C.) for producing galvanized steel sheets of deep drawing steel and high strength solid solution hardened steel. However, since the reheating period is very short, even if a part of the carbides precipitated by the overaging before galvanizing dissolve and form a solid solution, the resulting degradation of the mechanical properties is negligibly small.

The secondary cooling zone 11 is equipped with a gas jet cooler type cooling means.

The temper rolling mill 14 can be of the conventional type. The reason for employing the temper rolling mill 14 in the plant line in accordance with the invention is as follows.

Usually, when producing cold rolled thin steel sheets, temper rolling is carried out after overaging and when producing hot-dip galvanized steel sheets, it is also necessary to use temper rolling after the overaging treatment and galvanizing. More specifically, since the yield point of the overaged steel strips becomes low and the steel strip is therefore liable to yield, buckling caused by yield point elongation is liable to occur if the steel strip is passed therethrough as it is. Hence it is necessary to provide a temper rolling mill in the plant line in order to avoid this phenomenon. That is, it is necessary to eliminate the yield point elongation by temper rolling the steel strip as quickly as possible. In addition, it is preferred to use a large diameter roll for preventing the occurrence of buckling as the roll passes between the overaging zone and the temper rolling mill.

The chemical surface treatment means 16 is provided after the temper rolling mill 14. Ordinarly, for chemically treating the galvanized surface, a chemical treatment bath is located to follow the hot-dip galvanizing bath.

Such a chemical treatment is, as a matter of course, necessary for the galvanized steel sheets produced by the plant of this invention and thus the chemical treatment means 16 is disposed between the temper rolling mill 14 and the coiler 21. The reason for disposing the chemical treatment means at this position is that if the chemical treatment means is disposed before the temper rolling mill, the coating or layer formed by the chemical treatment will be mechanically broken by temper rolling.

In addition, in the plant of this invention, there is greater latitude in the selection of the kind of chemical treatment to be applied to the deep drawing galvanized steel sheets. This is because the plant of this invention is not subject to the limitation of the conventional production process for deep drawing galvanized steel sheets. Such a process is composed of four steps, namely hot-dip galvanizing, batch annealing, temper rolling and inspection, with the chemical treatment being performed in the hot-dip galvanizing step. There is thus the risk of the layer formed on the surface of the galvanized steel by the chemical treatment being broken by the temper rolling, so that it is impossible to use such chemical treatments as chromate treatment. Thus the present invention is superior in this connection to the conventional process by which only non-treated galvanized steel sheets which are simply can be produced.

The invention seeks to provide a plant which can be used for both the production of cold rolled steel sheets and the production of galvanized steel sheets and hence a bypass 22 is provided according to the first aspect of this invention for directly passing the steel strip S from the overaging zone 8 to the secondary cooling zone 11. An embodiment of the construction of the bypass 22 will be described with reference to the example shown in FIG. 2.

Figure 2:
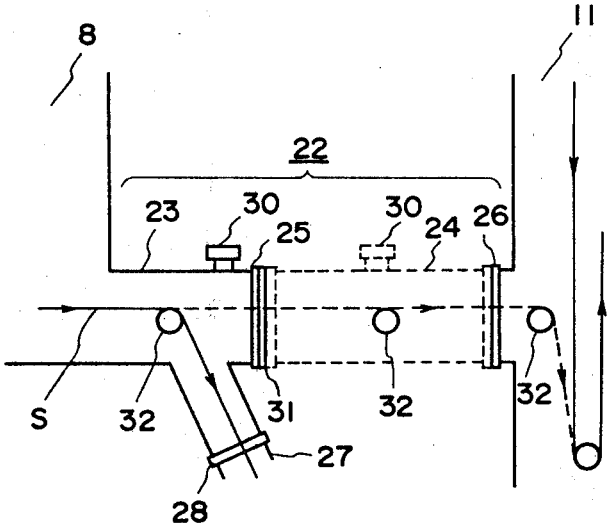
FIG. 2 is a schematic view showing an example of the bypass in the plant line shown in FIG. 1.

In FIG. 2, numeral 8 denotes the overaging zone 8 and numeral 11 denotes the secondary cooling zone 11 the same as in FIG. 1. Numeral 22 denotes a bypass directly connecting the overaging zone 8 and the secondary cooling zone 11. A branch 27 extends from an outlet portion 23 of the overaging zone 8 for introducing the overaged strip S to the hot-dip galvanizing apparatus 9 shown in FIG. 1.

For introducing the steel strip S from the overaging zone 8 to the secondary cooling zone 11 through the bypass 22, the bypass is constituted by a tunnel chamber 24 connected between the outlet portion 23 of the overaging zone 8 and the inlet portion 29 of the secondary cooling zone 11. The chamber 24 has flanges thereon connected to flanges 25 and 26. Numeral 28 denotes a sealing means for closing off the branch 27. A threaded hole 30 is provided in outlet portion 23 and tunnel chamber 24, and an end plate 31 is provided for closing the opening at flange 25 of the outlet portion 23. Guide rolls 32 are provided in outlet portion 23 in alignment with branch 27, in tunnel chamber 24 and in cooling zone 32.

The manner in which the bypass 22 is used will be described in connection with the following examples.

Figure 3:
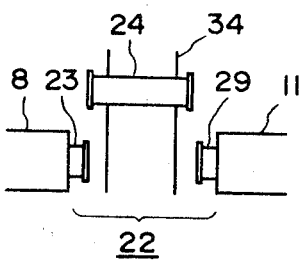
FIG. 3 is a schematic plan view showing the bypass removed in the case of producing galvanized steel sheets.
Figure 4:
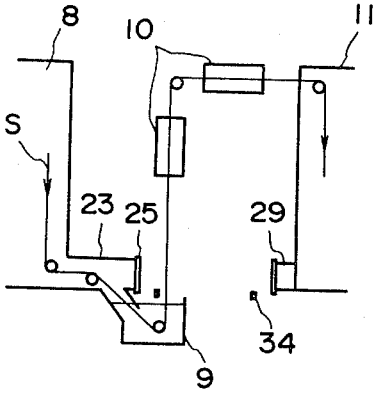
FIG. 4 is a schematic side view of the same arrangement as shown in FIG. 3.
Figure 5:
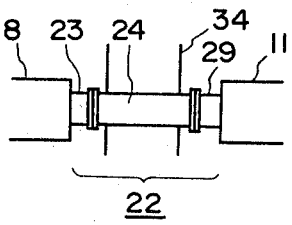
FIG. 5 is a schematic plan view showing the bypass installed for the production of cold rolled steel sheets.
Figure 6:
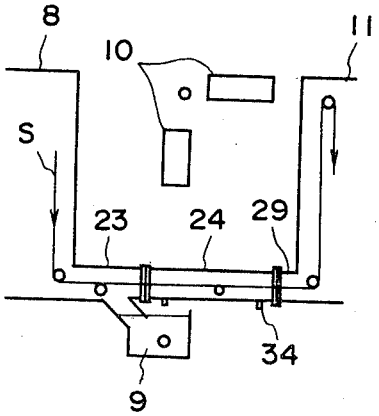
FIG. 6 is a schematic side view of the same arrangement as shown in FIG. 5.

In one example, the tunnel chamber 24 is transversely movably mounted. The tunnel chamber 24 of the bypass 22 is so constructed that the chamber can be horizontally moved transverse to the direction of movement of the steel strip S (the direction of the arrow) by means of rails 34 as shown in the plan view of FIG. 3. When producing a galvanized steel sheet, the tunnel chamber 24 is removed from the line along which the steel strip passes as shown in FIG. 3 and the cold rolled strip S is introduced from the overaging zone 8 into the secondary cooling zone 11 via the galvanizing bath 9 and the intermediate cooling means 10 as shown in FIG. 4. When producing a cold rolled steel sheet, the tunnel chamber 24 is connected to the outlet portion 23 and the inlet portion 29 to constitute the bypass 22 from the overaging zone 8 to the secondary cooling zone 11 as shown in FIG. 5 and the cold rolled steel strip S is passed directly from the overaging zone 8 into the secondary cooling zone 11 as shown in FIG. 6.

In another example, when producing a galvanized steel sheet, the tunnel chamber 24 is not removed from the line along which the steel strip S passes but, instead, the steel strip S rising from the galvanizing bath 9 is vertically passed through openings formed in the bottom and top surfces of the chamber 24. In this case, however, the zero spangling means 103 and the alloying means 104, which are usually positioned just above the galvanizing bath 9, must be positioned above the tunnel chamber 24 and hence less space is available for them.

Next, the plant line according to the second aspect of this invention will be described.

This plant is a dual-purpose production plant for higher grade cold rolled steel sheets and hot-dip galvanized steel sheets having excellent ductility. The plant comprising successively disposed in series, a heating zone, a soaking zone, a primary cooling zone, an overaging zone equipped with a controlled cooling facility, a hot-dip galvanizing means, an intermediate cooling means, a low-temperature overaging zone, a second cooling zone, a temper rolling means, and a chemical treatment means, and a bypass means for directly connecting said overaging zone and said low-temperature overaging zone with each other.

Figure 8:
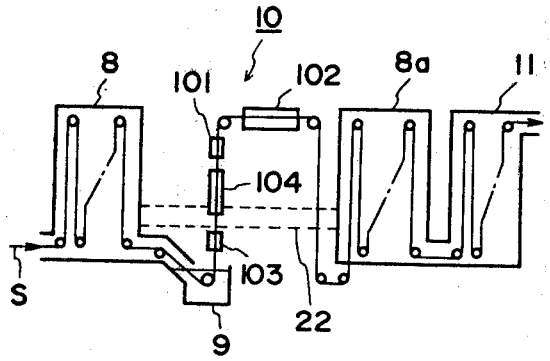
FIG. 8 is a schematic view of a part of a plant line showing an embodiment according to the second aspect of this invention.

As shown in FIG. 8, the constitution of the plant line according to the second aspect of this invention is the same as that of the plant line shown in FIG. 1 except that a low-temperature overaging zone 8*a* is disposed before the secondary cooling zone 11 so that the galvanized steel strip S is first introduced into the low-temperature overaging zone 8*a* after passing through the intermediate cooling section 10 and then introduced into the secondary cooling zone 11, and the bypass 22 is connected so that the steel strip S is directly passed from the overaging zone 8 to the low-temperature overaging zone 8*a* through the bypass when producing a cold rolled steel sheet.

Figure 10:
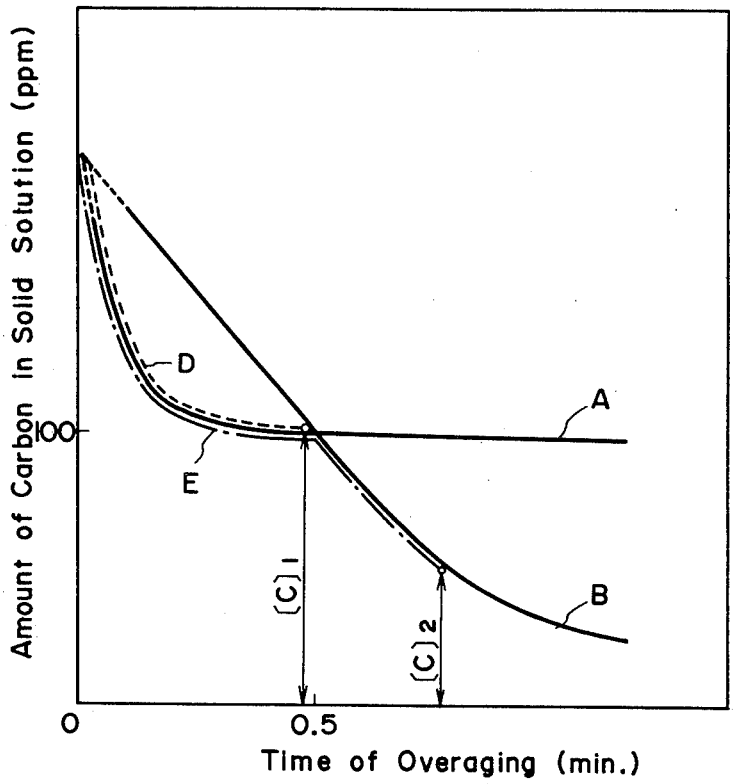
FIG. 10 is a graph showing the relationship between the change in the amount of carbon in solid solution in the steel strip and the overaging time and temperature.

The reason for employing the low-temperature overaging zone 8*a* in the plant line is as follows:

The purpose of applying the overaging treatment in the continuous annealing of steel strip is to make the carbon, which is retained in the ferrite phase of the steel structure during high-temperature soaking treatment, harmless by allowing it to precipitate during the overaging treatment and the extent to which this result can be attained depends upon the overaging temperature, which is explained with reference to FIG. 10. As will be understood from the graph shown in FIG. 10, an overaging treatment at a relatively high temperature of, e.g., 460° C. (Curve A), the amount of C in solid solution decreases to a certain value in a short period of time due to the high diffusibility of carbon at high temperature but thereafter, the amount of C in solid solution reaches equilibrium at the high temperature and hence the amount of C in solid solution does not decrease further. On the other hand, when holding the steel strip at a relatively low overaging temperature of, e.g., 300° C. (Curve B), it takes a long period of time to precipitate the carbon in solid solution due to its slow diffusion at low temperature but since the overaging temperature is lower, the amount of C in solid solution at equilibrium is lower, so that the amount of C in solid solution in the steel strip decreases finally to a very low value.

In the plant line according to the first aspect of this invention, the overaging treatment before galvanizing the steel strip is performed at a high temperature since the plant according to this aspect of the invention seeks to avoid reheating of the overaged steel strip before galvanizing. Consequently, a rather large amount of carbon remains in solid solution ($[C]_1$ in FIG. 10) as a result of the overaging treatment as shown by Curve D in FIG. 10 and has considerable influence on the ductility of the steel sheet. In general, however, the quality required of a galvanized steel sheet is usually one grade lower than that of a cold rolled steel sheet. Therefore, the steel sheet can, for the most part, suffice as a steel sheet for making a galvanized steel sheet of deep drawing steel or high strength solid solution hardened steel, though this depends on the product application.

However, for producing higher grade galvanized steel sheet having excellent ductility, it is required to carry out a more complete overaging treatment. In the plant line according to the second aspect of this invention, a low-temperature overaging zone (secondary overaging zone) is provided for satisfying the foregoing requirement yet so that no reheating of the overaged steel strip before the galvanizing treatment is required.

Thus, the steel strip subjected to the high-temperature overaging treatment in the overaging zone 8 is further subjected to a low-temperature overaging treatment in the low-temperature overaging zone 8*a* after being galvanized, whereby the amount of carbon in solid solution can be decreased ($[C]_2$ in FIG. 10) as shown by Curve E. Thus, the plant line according to the second aspect of this invention is suitable for producing higher grade galvanized steel sheets.

Thus, in the plant having the aforesaid feature, high-temperature overaging is carried out on the steel strip at about 460° C. in the overaging zone 8, the steel strip is galvanized in the galvanizing apparatus 9, and then after intermediate cooling, low-temperature overaging is carried out on the steel strip at about 300° C. by passing the steel strip through the low-temperature overaging zone 8*a*. Thus, deep drawing galvanized steel sheets and high strength solid solution hardened galvanized steel sheets having good ductility can be produced without the need of a reheating step before galvanizing and without zinc pick-up by the hearth roll in the low-temperature overaging zone 8*a*.

Next, the plant according to the third aspect or third feature of this invention will be described. This plant is a dual-purpose production plant for cold rolled steel sheets and galvanized steel sheets of high strength dual-phase steel comprising, successively disposed in series, a heating zone, a soaking zone, a primary cooling zone, a controlled cooling zone, a hot-dip galvanizing means, an intermdiate rapid cooling means, a secondary cooling zone, a temper rolling means, and a chemical treatment means, said controlled cooling zone and said secondary cooling zone with each other.

Figure 9:
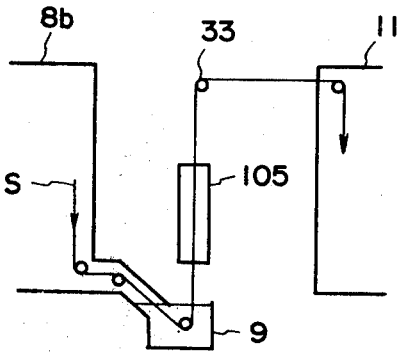
FIG. 9 is a schematic view showing an example of a quenching section disposed between the hot-dip galvanizing bath and the secondary cooling zone for use in producing galvanized steel sheets of high strength dual-phase steel according to still another embodiment according to a third aspect of this invention.

The construction of the plant is the same as that of the plant shown in FIG. 1 except that, as shown in FIG. 9, a controlled cooling zone 8*b* equipped with a cooling means such as a weak cooling gas jet cooler or cooling tube is employed in place of the overaging zone 8 in the plant shown in FIG. 1 and an intermediate rapid cooling section 105 is employed in place of the intermediate cooling section 10 in FIG. 1.

For producing a cold rolled steel sheet of high strength dual-phase steel, a steel strip soaked to a temperature of, for example, $Ac_1$ to $Ac_3$ in the soaking zone 6 is rapidly cooled in a single operation to a temperature below the Ms temperature (the starting point of martensite transformation) in the primary cooling zone 7 to form a dual-phase structure in the steel strip, the strip is passed through the controlled cooling zone 8*b*, the bypass 22 and the secondary cooling zone 11, cooled to almost room temperature in the water cooling means 12, and then after being passed through a temper rolling mill 14, is coiled.

On the other hand, for producing a high strength dual-phase hot-dip galvanized steel sheet, a steel strip from the soaking zone 6 is passed through the primary cooling zone 7 (see FIG. 1) the cooling means of which is kept inoperable, slowly cooled during passage through the controlled cooling zone 8*b* to enrich the carbon in the $\gamma$-phase while maintaining the $\gamma$-phase in the steel strip, and after being galvanized in the hot-dip galvanizing bath 9, is cooled in a single operation to a temperature below the Ms temperature at a cooling rate of 15°-500° C./sec. in the intermediate rapid cooling section 105 to form a dual-phase structure.

The construction of the intermediate rapid cooling section 105 for attaining the cooling rate of 15°-500° C./sec. will now be described. Practical means for use in the intermediate rapid cooling section 105 includes a strong cooling type gas jet cooling system, a fog cooling system and a metal contact cooling system. The strong cooling type gas jet cooling system and fog cooling system have cooling rates in the range of about 15°-500° C./sec., which is not excessively fast, and hence when such a cooling system is employed, no super-saturation of carbon in solid solution in the steel strip occurs and therefore, a subsequent reheating or overaging treatment is not required.

The strong cooling type gas jet cooler is a gas jet cooling system employing a higher blowing pressure or a lower gas temperature than an ordinary gas jet cooler. In addition, when producing a two-side galvanized steel sheet, air may be used as the "gas" in the cooling system but when producing a one-side galvanized steel sheet, it is necessary to use an inert gas such as $N_2$ gas for bright cooling. The fog cooling system is a cooling system for cooling a steel strip by blowing thereon a water-gas mixture. Since the cooling rate of the fog cooling system is higher than the foregoing gas jet cooler, the employment of the cooling system is advantageous for the production of high strength dual-phase galvanized steel sheet, but in this case, it is necessary to remove water from the steel strip by means of a gas wiper, etc., so that the water drops blown onto the steel strip do not flow down into the galvanizing bath disposed under the cooling system. However, for producing a one-side galvanized steel sheet, the employment of the fog cooling system is not preferred since the non-galvanized surface of the steel strip is oxidized by the water applied. A metal conduct system can also be employed and since the system can perform bright cooling, it can be used for producing a one-side galvanized steel sheet. Also, since the metal contact cooling system can produce a cooling rate higher than that of the strong cooling type gas jet cooler, it can be advantageously used for the production of a high strength dual-phase galvanized steel sheet.

In addition, when producing galvanized steel sheets of high strength dual-phase steel using the plant according to the third aspect of this invention, it sometimes occurs that the cooling rate for the steel strip exceeds the prescribed cooling rate even during natural cooling while the steel strip is passed through the primary cooling zone (the cooling means of which is kept inoperative) and hence a heat retaining means such as an indirect electric resistance heating means may be provided in the primary cooling zone.

Also, by using a heat retaining means such as an indirect electric resistance heating means in the controlled cooling zone 8*b*, the cooling zone can be made to function as an overaging zone. Therefore, in this case the plant according to the third aspect of this invention can also be used as a dual-purpose production plant for cold rolled steel sheets and galvanized steel sheets of deep drawing steel and high strength solid solution hardened steel.

Now the production of cold rolled steel sheets and the production of hot-dip galvanized steel sheets by the plant of this invention will be described in detail with reference to the following examples.

First, the production of a deep drawing cold rolled steel sheet by the plant according to the first aspect of this invention will be described.

A steel strip obtained by hot rolling aluminum killed steel, coiling at high temperature, and then cold rolling is cleaned by means of the electrolytic cleaning means 3 and passed through the entry looper 4, the heating zone 5 of the radiant tube type wherein the steel strip is heated to a temperature above the recrystallizing temperature, and then through the soaking zone 6 equipped with a heat retaining means wherein the steel strip is heated to the aforesaid temperature above the recrystallizing temperature for longer than 10 sec. The steel strip is then cooled to about 450° C. in a bright cooling atmosphere at a cooling rate of about 5°-50° C./sec. in the primary cooling zone 7 equipped with a gas jet cooler, subjected to overaging for 1-3 minutes, for example 2 minutes, at a temperature in the range of about 450°-300° C. in the overaging zone 8, passed through the tunnel chamber 24 moved into position as a bypass as shown in FIG. 5 and FIG. 6, cooled to about 300° C. at a cooling rate of about 5° C./sec in the secondary cooling zone 11 equipped with a gas jet cooler, and then cooled to room temperature in the water cooling means 12. Thereafter, the steel strip is passed through the delivery looper 13, temper-rolled by the temper rolling mill 14, and then coiled by means of the coiler 21 after passing through the trimmer 15, the inspection means 18, the oil coater 19, and the shearing machine 20. Thus, a deep drawing cold rolled steel sheet is produced.

Next, the production of a deep drawing hot-dip galvanized steel sheet by the same plant as above using the same starting material as above will be described.

In this case, the tunnel chamber 24 of the bypass 22 is removed as shown in FIG. 3 and the steel strip is introduced into the secondary cooling zone 12 from the overaging zone 8 through the hot-dip galvanizing bath 9 and the intermediate cooling means 10. Furthermore, the secondary cooling zone 11, the trimmer 15 and the oil coater 19 are kept inoperable.

The cold rolled steel strip S continuously treated in the heating zone 5, the soaking zone 6 and the primary cooling zone 7 under the same conditions as above is passed through the overaging zone 8 so as to be overaged at 600°-450° C., for example 460° C., for 1-3 minutes, for example 2 minutes, and then passed through the hot-dip galvanizing bath 9 of 450°-500° C. (e.g. 460° C.) so as to be galvanized and then passed through the zero-spangling apparatus 103. The steel strip thus zero-spangled is cooled to about 350° C. in the primary intermediate cooling section 101, cooled to about 300° C. in the secondary intermediate cooling section 102, passed through the secondary cooling zone 11 and then cooled to room temperature in the water-cooling means 12. The steel strip is then passed through the delivery looper 13, chromate-coated in the chemical treatment section 16, and coiled by means of the coiler 21 after passing through the dryer 17 and the inspection means 18. Thus, a deep drawing chemically treated galvanized steel sheet having excellent mechanical properties, zinc coat adherence and corrosion resistance is obtained.

Also, in the same manner as above, cold rolled steel sheets and galvanized steel sheets of high strength solid solution hardened steel can be produced by the plant of this invention.

Next, the the production of a higher grade deep drawing cold steel sheet having excellent ductility by the plant according to the second aspect of this invention will be described. In this case, the overaging zone 8 is connected to the low-temperature overaging zone **8*a* through the bypass 22**.

An aluminum-killed steel strip produced by hot rolling and cold rolling in an ordinary manner is sent to the heating zone 5 through the electrolytic cleaning means 3 and the entry looper 4, wherein the steel strip is heated to a temperature above the recrystallizing temperature, and it is then introduced into the soaking zone 6 wherein the steel strip is soaked for longer than 10 seconds at the same temperature as above. The steel strip is then introduced into the primary cooling zone 7, wherein it is cooled to about 450° C. at a cooling rate of 5°-50° C./sec. in a bright cooling atmosphere, passed through the overaging zone 8 and the low-temperature overaging zone **8*a* so as to be overaged at about 450°-300° C. through both zones for about 1-3 minutes, for example 3 minutes, and passed through the cooling zone 11 and the water cooling means 12 so as to be cooled to room temperature. The steel strip is then temper-rolled by the temper rolling mill 14 and coiled by means of the coiler 21 after passing through the trimmer 15, the inspection means 18, the oil coater 19 and the shearing machine 20**. Thus, a higher grade deep drawing cold steel sheet having excellent ductility is produced.

Next, the method for producing a higher grade deep drawing galvanized steel sheet having excellent ductility by the same plant as above using the same starting material as above will be described. In this case, the bypass 22 is removed from the line.

The cold reduced steel strip of the same material as above passed through the heating zone 5 and the soaking zone 6 under the same conditions as above and is cooled to about 600°-450° C. (e.g. 460° C.) in the primary cooling zone 7, introduced into the overaging zone 8 wherein the steel strip is overaged for 1-3 minutes (e.g. 2 minutes) at a temperature of about 600°-450° C. (e.g. 460° C.), and then passed through a hot-dip galvanizing bath 9 at a temperature in the range of about 450°-500° C. (e.g. 460° C.). Then, immediately after leaving the galvanizing bath 9, the steel strip thus galvanized is passed through the alloying furnace 104, wherein the galvanized layer is alloyed at a temperature of about 500°-600° C. (e.g. 550° C.), cooled to about 300° C. in the intermediate primary cooling section 101 and the intermediate secondary cooling section 102 of the intermediate cooling section 10, and then introduced to the low-temperature overaging zone **8*a* wherein it is low-temperature overaged for a period shorter than 180 sec., for example 60 sec., at a temperature in the range of about 300°-250° C. By this low-temperature overaging, not only does carbon in solid solution reach equilibrium at the low temperature so as to give the steel strip excellent ductility, but also even the carbon dissolved in solid solution during the alloying treatment fully precipitates, whereby the degradation of the mechanical properties as a result of the alloying treatment is prevented. Thereafter, the steel strip is cooled to room temperature in the secondary cooling zone 11 and the water cooling zone 12, passed through the delivery looper 13, chromate-coated in the chemical treatment means 16, and then coiled by the coiler 21 after passing through the dryer 17, the inspection means 18, and the shearing machine 20**. Thus, a higher grade deep drawing chemically treated galvanized steel sheet having excellent mechanical properties (in particular ductility), zinc coat adherence and corrosion resistance can be produced.

By the same manner as above, higher grade cold rolled steel sheets and galvanized steel sheets of high strength solid solution hardening steel having excellent ductility can be produced.

Next, the operation of the plant according to the third aspect of this invention will be explained.

This plant is mainly used for the production of cold rolled steel sheets and galvanized steel sheets of high strength dual-phase steel. When producing a cold rolled steel sheet, the controlled cooling zone 8b is connected to the secondary cooling zone 11 by the tunnel type chamber 24 as a bypass.

A cold reduced strip of 1–2% Mn-steel produced in an ordinary manner is introduced into the heating zone 5 through the electrolytic cleaning means 3 and the entry looper 4, wherein the steel strip is heated to a temperature in the range from the $Ac_1$ transformation temperature to the $Ac_3$ transformation temperature and is then introduced into the soaking zone 6 wherein it is soaked for longer than 20 sec. at the same temperature as above. Then, the steel strip is introduced into the primary cooling zone 7 wherein it is rapidly cooled in one operation to a temperature below the Ms temperature in a bright atmosphere at a cooling rate of about 5°–50° C./sec., passed through the controlled cooling zone 8b, the bypass (tunnel chamber 24), the secondary cooling zone 11 and the water cooling means 12, whereby the steel strip is cooled to room temperature, is temper-rolled by the temper rolling machine 14, and is coiled by the coiler 21 after passing through the trimmer 15, the inspection means 18, and the shearing machine 20. Thus, a high strength dual-phase cold rolled steel sheet is produced.

The operation of producing a hot-dip galvanized steel sheet of the same quality as above will now be described.

The cold reduced steel strip of the same material as above is heated in the heating zone 5, soaked in the soaking zone 6 under the same conditions as above, and then passed through the primary cooling zone 7 and the controlled cooling zone 8b, wherein it is slowly cooled to a temperature of about 450°–500° C. at a cooling rate of lower than about 15° C./sec. during passage therethrough. The steel strip is immersed at a temperature of about 450°–500° C. in the hot-dip galvanizing bath 9 so as to be coated with a zinc coating, introduced into the intermediate rapid cooling section 105 wherein it is rapidly cooled to below the Ms temperature at a cooling rate of about 15°–500° C./sec., cooled to room temperature in the secondary cooling zone 11 and the water cooling means 12, introduced into the chemical treatment means through the delivery looper 13 whereby it is subjected to a chemical treatment, and then coiled by the coiler 21 after passing through the dryer 17, the inspection means 18, and the shearing machine 20. Thus, a high strength dual-phase chemically treated galvanized steel sheet having excellent mechanical properties, zinc coating adherence and corrosion resistance is produced.

The advantages of the plant of this invention are as follows:

Since the plant of this invention functions both as a production line for cold rolled steel sheet and as a production line for hot-dip galvanized steel sheet, the cost of the plant and equipment can be reduced by about 30–40% below that for two separate lines. Also, fixed operating costs for labor and maintenance can be reduced.

By producing deep drawing hot-dip galvanized steel sheets using the plant of this invention, the production cost is reduced as compared with using a conventional "post annealing" process composed of the four steps, namely hot-dip galvanizing, batch annealing, temper rolling and inspection. More specifically, in the plant according to this invention, the overaging zone, temper rolling mill, and inspection section originally employed in a continuous annealing line for cold rolled steel sheets can be practically utilized and hence such deep drawing galvanized steel sheets can be produced in-line. As a result, the transportation cost is reduced, the loss of steel strip by coil handling is reduced so as to increase the yield of the product etc. and thus the production cost for products is reduced on the whole.

The zinc coating adherence of the galvanized steel sheets produced by the plant of this invention is superior to that of the sheets produced by the conventional "post annealing" process. Since in the conventional process, a steel strip is subjected to overaging after hot-dip galvanizing, there is a problem that alloying occurs at the interface between base iron of the steel strip and the galvanized layer so as to reduce the zinc coat adherence. However, in the plant according to this invention, since the overaging is performed before the hot-dip galvanizing step, there is no risk of deteriorating the zinc coating adherence. This is particularly important for deep drawing hot-dip galvanized steel sheets which generally are subjected to severe deforming.

Since by the plant of this invention, the chemical treatment of the hot-dip galvanized steel sheet is performed after temper rolling, there is no risk of breaking the chemically treated coating on the steel sheets by the temper rolling and hence any desired type of chemical treatment can be performed even for deep drawing galvanized steel sheets. This is a considerable advantage over the conventional "post annealing" process of producing deep drawing galvanized steel sheets wherein the temper rolling is performed after the chemical treatment.

In the plant of this invention, continuous annealing is employed in place of conventional batch annealing in the production of galvanized steel sheets and hence consistent product quality can be assured and the flatness of the products can be stabilized and improved. Also, when producing a one-side galvanized steel sheet, surface defects on the non-galvanized surface of the steel sheet can be reduced so as to improve the surface quality of the product.

By the plant of this invention, the number of days required for producing products can be reduced as compared with the conventional "post annealing" process and hence the products can be produced and shipped quickly so as to greatly improve the service to customers.

By the plant of this invention, high strength dual-phase galvanized steel sheet can be produced as a new product without reducing productivity.

In a conventional continuous hot-dip galvanizing line, there is employed neither an ordinary slow cooling facility before galvanizing nor a rapid cooling facility directly after galvanizing, and hence dual-phase galvanized steel sheets cannot be produced.

In the plant of this invention, the overaging zone or the controlled cooling zone through which the steel strip is passed before galvanizing is equipped with an intermediate controlled cooling means and also with an intermediate rapid cooling means for rapidly cooling the steel strip directly after galvanizing, and hence the production of the high strength dual-phase galvanized steel sheets can be advantageously carried out.

What is claimed is:

1. A dual-purpose production plant for producing either cold rolled steel sheets or hot-dip galvanizing steel sheets, comprising, successively disposed one directly after the other in series, a heating zone, a soaking zone, a primary cooling zone, an overaging zone having a controlled cooling facility therein, a hot-dip galvanizing means, an intermediate cooling means, a secondary cooling zone, a temper rolling means, and a chemical treatment means, and a bypass means for directly connecting said overaging zone and the secondary cooling zone with each other.

2. The dual-purpose plant as claimed in claim 1 wherein said heating zone has a radiant tube type indirect heating means therein.

3. The dual-purpose plant as claimed in claim 1 wherein said primary cooling zone has at least one cooling means therein taken from the group consisting of a gas jet cooling type cooling means and a metal contact type cooling means.

4. The dual-purpose plant as claimed in claim 1 wherein said overaging zone has a cooling means therein which is a weak cooling gas jet cooling type cooling means or a cooling tube type cooling means, and said overaging zone further has an indirect electric resistance heating means therein.

5. The dual-purpose plant as claimed in claim 1 wherein the zones before the hot-dip galvanizing means have a reducing gas atmosphere therein.

6. The dual-purpose plant as claimed in claim 1 wherein said intermediate cooling means is a strong cooling gas jet cooler, a fog cooler, a metal contact cooler or a combination thereof.

7. The dual-purpose plant as claimed in claim 1 wherein at least one means taken from the group consisting of a zero-spangling means and an alloying means is provided between said hot-dip galvanizing means and said intermediate cooling means.

8. The dual-purpose plant as claimed in claim 1 wherein said hot-dip galvanizing means has a one-side galvanizing means as a part thereof.

9. The dual-purpose plant as claimed in claim 1 wherein said bypass means is a movable tunnel chamber connecting said overaging zone and said secondary cooling zone.

10. A dual-purpose production plant for producing either cold rolled steel sheets or hot-dip galvanized steel sheets, comprising, successively disposed in series, a heating zone, a soaking zone, a primary cooling zone, an overaging zone having a controlled cooling facility therein, a hot-dip galvanizing means, an intermediate cooling means, a low-temperature overaging zone, a secondary cooling zone, a temper rolling means, and a chemical treatment means, and a bypass means for directly connecting said overaging zone and said low-temperature overaging zone with each other.

11. The dual-purpose plant as claimed in claim 10 wherein said heating zone has a radiant type intermediate heating means.

12. The dual-purpose plant as claimed in claim 10 wherein said primary cooling zone has at least one cooling means therein taken from the group consisting of a gas jet cooling type cooling means and a metal contact type cooling means.

13. The dual-purpose plant as claimed in claim 10 wherein said overaging zone has a cooling means therein which is a weak cooling gas jet cooling type or cooling tube type cooling means, and said overaging zone further has an indirect electric resistance heating means therein.

14. The dual-purpose plant as claimed in claim 10 wherein the zones before said hot-dip galvanizing means have a reducing gas atmosphere therein.

15. The dual-purpose plant as claimed in claim 10 wherein said intermediate cooling means is a rapid cooling means comprising a strong cooling gas jet cooler, a fog cooler, a metal contact cooler, or a combination thereof.

16. The dual-purpose plant as claimed in claim 10 wherein at least one of means taken from the group consisting of a zero-spangling means and an alloying means is provided between said hot-dip galvanizing means and said intermediate cooling means.

17. The dual-purpose plant as claimed in claim 10 wherein said hot-dip galvanizing means has a one-side galvanizing means as a part thereof.

18. The dual-purpose plant as claimed in claim 10 wherein said bypass means is a movable tunnel chamber connecting said overaging zone and said low-temperature overaging zone.

19. A dual-purpose production plant for producing either cold rolled steel sheets or hot-dip galvanized steel sheets, comprising, successively disposed one directly after the other in series, a heating zone, a soaking zone, a primary cooling zone, a controlled cooling zone, a hot-dip galvanizing means, an intermediate rapid cooling means, a secondary cooling zone, a temper rolling means, and a chemical treatment means, and a bypass means for directly connecting said controlled cooling zone and said secondary cooling zone with each other.

20. The dual-purpose plant as claimed in claim 19 wherein said heating zone has a radiant type indirect heating means therein.

21. The dual-purpose plant as claimed in claim 19 wherein said primary cooling zone has at least one cooling means therein taken from the group consisting of a gas jet cooling type cooling means and a metal contact type cooling means.

22. The dual-purpose plant as claimed in claim 19 wherein said controlled cooling zone has an indirect electric resistance heating means therein and has a weak cooling gas jet cooling type cooling means or cooling tube type cooling means therein.

23. The dual-purpose plant as claimed in claim 19 wherein said intermediate rapid cooling means comprises a strong cooling gas jet cooler, a fog cooler, a metal contact cooler, or a combination thereof.

24. The dual-purpose plant as claimed in claim 19 wherein at least one means taken from the group consisting of a zero-spangling means and an alloying means is provided between said hot-dip galvanizing means and said intermediate rapid cooling means.

25. The dual-purpose plant as claimed in claim 19 wherein said hot-dip galvanizing means has a one-side hot-dip galvanizing means as a part thereof.

26. The dual-purpose plant as claimed in claim 19 wherein said bypass means is a movable tunnel chamber connecting said controlled cooling zone and said secondary cooling zone.

* * * * *